US007735991B2

(12) United States Patent
Asano

(10) Patent No.: US 7,735,991 B2
(45) Date of Patent: Jun. 15, 2010

(54) RECORDING APPARATUS

(75) Inventor: Shinya Asano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1059 days.

(21) Appl. No.: 11/411,812

(22) Filed: Apr. 27, 2006

(65) Prior Publication Data

US 2006/0256180 A1 Nov. 16, 2006

(30) Foreign Application Priority Data

May 12, 2005 (JP) ..... 2005-139560

(51) Int. Cl.
*B41J 2/01* (2006.01)

(52) U.S. Cl. ..... 347/102; 101/25; 101/54; 101/56; 101/57; 347/104; 347/187; 347/214; 400/23; 400/55; 400/56; 400/57; 400/58

(58) Field of Classification Search ..... None
See application file for complete search history.

(56) References Cited

U.S. PATENT DOCUMENTS 4,023,662 A * 5/1977 Perucca ..... 400/57
4,620,807 A * 11/1986 Polit ..... 400/56
5,079,587 A * 1/1992 Tanabe et al. ..... 355/403
5,274,399 A * 12/1993 Uchida et al. ..... 346/134
5,797,687 A * 8/1998 Petersen et al. ..... 400/23
6,834,925 B2 12/2004 Ikeda
6,997,623 B2 2/2006 Nebashi
7,101,036 B2 * 9/2006 Nakashima et al. ..... 347/104

FOREIGN PATENT DOCUMENTS

CN 1432475 7/2003

* cited by examiner

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

A recording apparatus is advantageous in miniaturization even though a mechanism for adjusting a head gap is included. The recording apparatus includes a carriage for detachably holding a cartridge, a platen for supporting one surface of a recording medium, and a conveying roller and an eject roller for conveying the recording medium. The platen is constructed so that it is rockable with an axis of the eject roller as a rotation center and is switchable between at least two positions.

6 Claims, 11 Drawing Sheets

RECORDING APPARATUS

BACKGROUND OF THE INVENTION

1. Field of the Invention

The present invention relates to a recording apparatus adopting, for instance, an ink jet system, and more particularly, to a recording apparatus constructed so that a distance (head gap) between a platen and a recording head can be adjusted.

2. Related Background Art

Conventionally, an ink jet recording apparatus is known which has a construction including a carriage for holding a recording head, a platen for supporting one surface (rear or back surface) of a recording medium in an area opposing a discharge port surface of the recording head, and several rollers for conveying the recording medium.

In the recording apparatus, a predetermined distance (hereinafter referred to as "head gap") is secured between the recording medium supported on the platen, and the discharge port surface of the recording head and recording is performed by discharging ink from the recording head toward the recording medium in this state. Note that it is known that a smaller head gap is more advantageous in obtaining a clear and high-quality recording result.

Incidentally, the recording medium onto which the recording apparatus can perform recording is not limited to a general recording sheet (plain paper) but includes various other media such as a postal card and an OHP sheet (resin thin plate). In addition, processed paper (such as a sheet with punch holes, a perforated sheet, and a sheet with an arbitrary contour shape) an envelope, and the like are also usable, which means that more and more kinds of recording media have been usable.

In a case of a recording apparatus that performs recording onto such various recording media, a construction in which a head gap can be adjusted in accordance with the thicknesses of the recording media is preferable in order to obtain favorable recording results with this construction. For instances a construction may be used in which a classification into a case where recording is performed onto relatively thin recording media (such as plain paper) and a case where recording is performed onto relatively thick recording media (such as a postal card) is made and the head gap is switched in a two-step manner. With this construction, it is possible to adjust the head gap as appropriate in accordance with the thicknesses of the recording media, which makes it possible to obtain favorable recording results.

U.S. Pat. No. 6,834,925 discloses an ink jet recording apparatus which includes an adjustment mechanism for adjusting a head gap. The adjustment mechanism is provided for a carriage, and the head gap is adjusted through a vertical motion of the carriage in response to an operation of the mechanism by a user.

With the construction described in U.S. Pat. No. 6,834,925, however, the head gap is adjusted through the vertical motion of the carriage, so it is required to secure a space for the vertical motion of the carriage in the casing of the apparatus. There is a case where the construction including such the space is disadvantageous in miniaturization of the recording apparatus, and the conventional recording apparatus has room for improvement in this regard.

SUMMARY OF THE INVENTION

An object of the present invention is to provide a recording apparatus that is advantageous in miniaturization even when a mechanism for adjusting a head gap is included.

Another object of the present invention is to provide a recording apparatus including: a carriage mounted with recording means for forming an image on a recording medium, which serves to move; a roller for conveying the recording medium in a direction intersecting a main scan direction; and a platen for supporting the recording medium in an area in which the image is formed, the platen being constructed to be rockable about an axis of the roller and switchable between at least two postures.

BRIEF DESCRIPTION OF THE DRAWINGS

FIGS. 7A and 7B are each a cross-sectional view for explanation of a positional relation between the link and the platen and the like;

DESCRIPTION OF THE PREFERRED EMBODIMENTS

Hereinafter, embodiments of the present invention will be described with reference to the accompanying drawings.

First Embodiment

Figure 1:
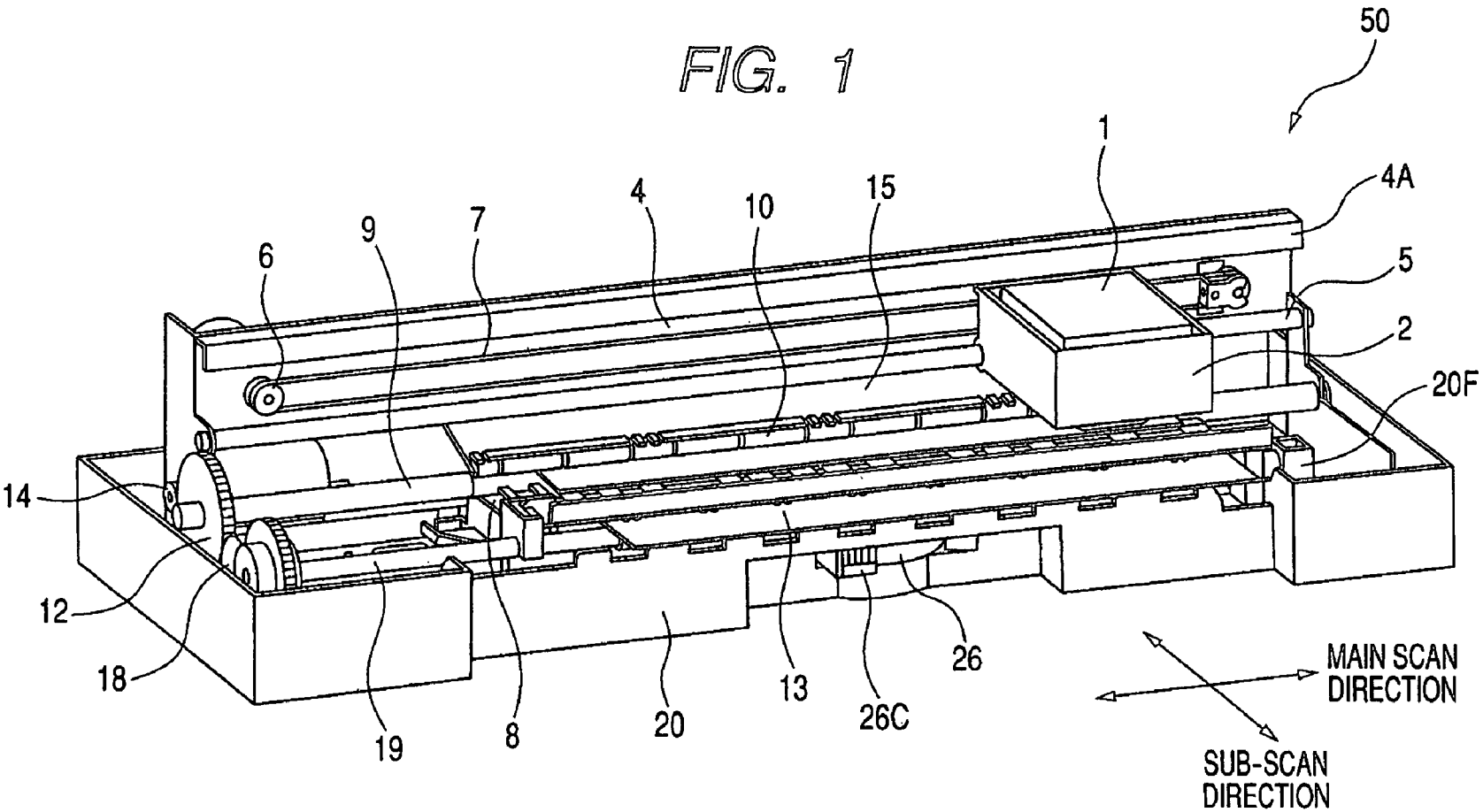
FIG. 1 is a perspective view showing a construction of a recording apparatus according to a first embodiment to which the present invention is applied.
Figure 2A:
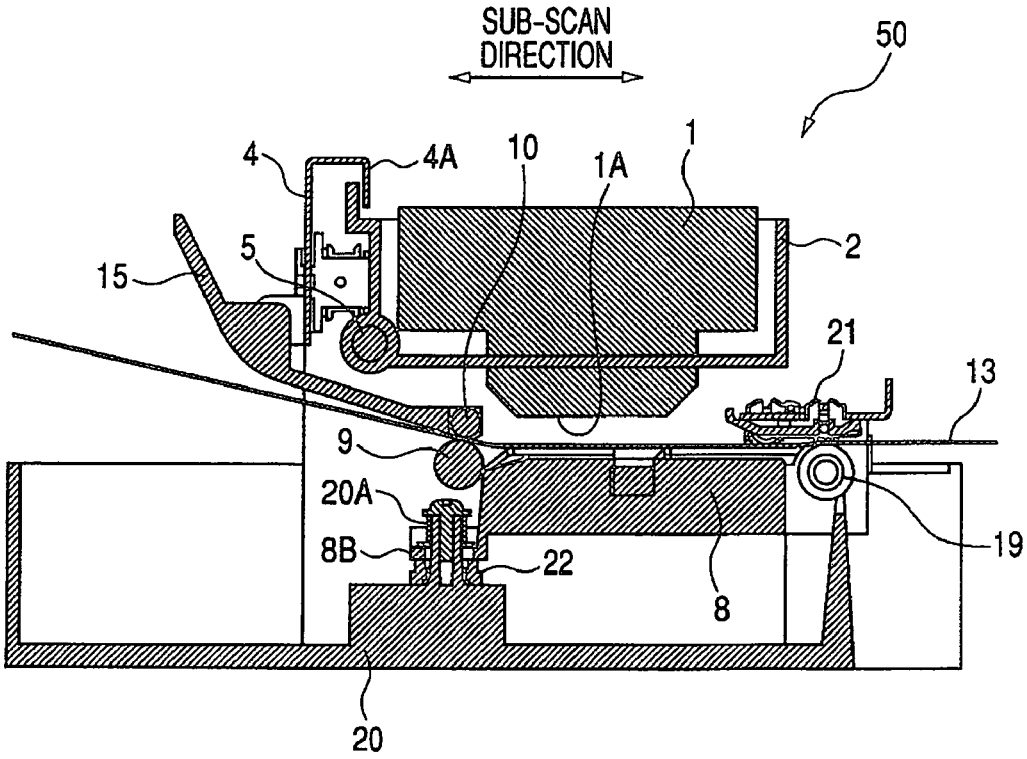
FIGS. 2A and 2B are each a cross-sectional view of the recording apparatus of FIG. 1 in which the recording apparatus is cut in a sub-scan direction.
Figure 2B:
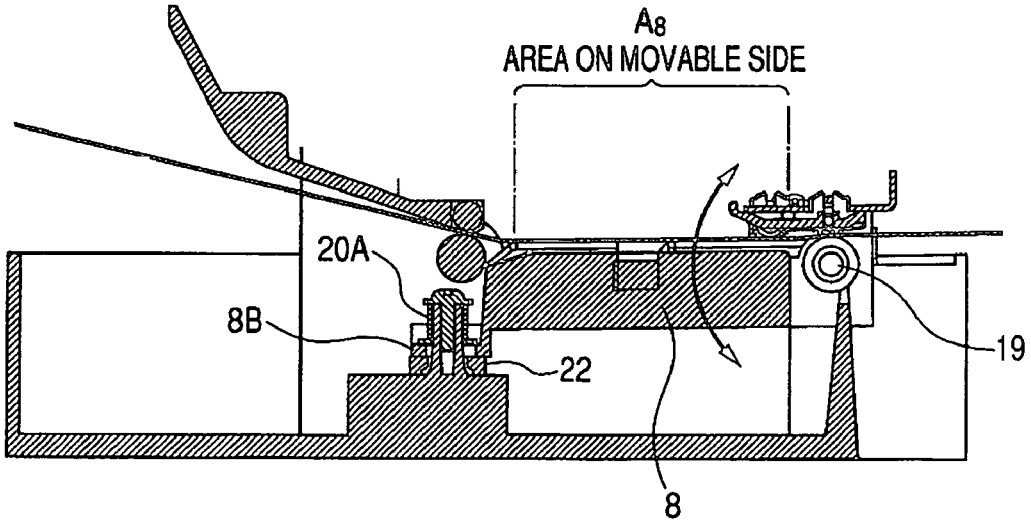

First, a fundamental construction of a recording apparatus of a first embodiment will be described with reference to FIG. 1 to FIG. 2B. FIG. 1 is a perspective view showing an example of the construction of the recording apparatus to which the present invention is applied. FIGS. 2A and 2B are each a cross-sectional view of the recording apparatus of FIG. 1 in which the recording apparatus is cut in a sub-scan direction, with FIG. 2A showing a state in which a platen is moved upward while FIG. 2B showing a state in which the platen is moved downward.

As shown in FIG. 1 to FIG. 2B, an ink jet recording apparatus 50 is a recording apparatus of so-called serial scan type that includes a carriage 2 for holding a recording head cartridge 1, multiple rollers 9, 19 and the like for conveying a recording medium 13 in the sub-scan direction, and a platen 8 for supporting a rear surface of the recording medium 13. Note that a main feature of the recording apparatus 50 of this embodiment is that a head gap can be adjusted through movement of not a cartridge 1 side but a platen 8 side.

The recording head cartridge 1 is obtained by constructing a recording head (recording means) that discharges ink toward the recording medium and an ink tank that reserves ink supplied to the recording head integrally with each other and is detachably attachable to the carriage 2. In a state in which the cartridge 1 has been attached to the carriage 2, a discharge port surface 1A of the recording head opposes the upper surface of the platen 8 (see FIGS. 2A and 2B). Note that the recording head cartridge 1 is not limited to this construction and a construction is also possible in which the recording head and the ink tank are separable from each other.

With a construction described below, the carriage 2 is reciprocatingly moved in a main scan direction. That is, as shown in FIG. 2A, a part of the carriage 2 is supported by a guide shaft 5 in a free-to-slide manner and another part thereof is supported by a rail portion 4A of a frame 4. With this construction, the carriage 2 is placed in a state in which it is free to move along the guide shaft 5 while maintaining a certain posture. As construction elements for moving the carriage 2, as shown in FIG. 1, a CR motor 6 attached to the frame 41 a belt 7 that is driven by the motor, and the like are provided. Through forward/backward rotation of the CR motor 6 based on a predetermined electric signal, the carriage 2 is moved in the main scan direction by a distance corresponding to the number of revolutions of the CR motor 6.

It should be noted that the frame 4 is a member that supports various construction elements of the recording apparatus such as the CR motor 6. In addition, as a similar member, a main body base 20 that supports the frame 4 is provided.

Next, a mechanism for conveying the recording medium will be described with reference to FIG. 3 as well as FIG. 1 and FIGS. 2A and 2B.

The convey roller 9 and a pinch roller 10 are provided in a state in which they contact each other on an upstream side in the sub-scan direction with respect to the recording head cartridge 1. Note that in FIG. 3, a state in which the recording medium 13 is nipped-between a pair of the rollers 9 and 10 is illustrated, but conveying of the recording medium until the nip between the rollers 9 and 10 is performed by another conveying mechanism (not shown).

As shown in FIG. 1, the conveying roller 9 is pivotally supported by bearings formed for both side walls of the frame 4 so that it is free to rotate. To an end portion on a left side of the drawing of the conveying roller 9, an LF gear 12 is attached. Through reception of a driving force from an LF motor 14 by the LF gear 12, the conveying roller 9 is driven to rotate.

The pinch roller 10 is made free to rotate through attachment to a pinch roller holder 15 in a free-to-slide manner. The pinch roller holder 15 is urged against a conveying roller 9 side by a pinch roller spring (not shown), so the pinch roller 10 is brought into pressure contact with the conveying roller with a predetermined urging force.

On a downstream side in the sub-scan direction of the cartridge 1, the sheet eject roller 19 and a spur 21 for delivering the recording medium having undergone recording are arranged. To the eject roller 19, the driving force from the LF motor 14 (see FIG. 1) is transmitted through the LF gear 12 and an idler gear 18. That is, the conveying roller 9 and the sheet eject roller 19 are constructed so that they are driven by the same drive source. With this construction, both the rollers are driven in a synchronized manner. The spur 21 is attached to a spur stay 3 and is brought into pressure contact with the sheet eject roller 19 with a predetermined urging force like in the case of the pinch roller 10. Note that each of the guide shaft 5, the conveying roller 9, and the eject roller 19 is arranged so that an axis thereof coincides with the main scan direction.

In an area between the conveying roller 9 and the eject roller 19 constructed in the manner described above, the platen 8 is provided in a state in which it opposes the discharge port surface 1A of the recording head cartridge 1. In FIG. 3, a part of the surface of the platen is shown as a recording area 65. The recording area 65 is an area including an area in which the ink is discharged toward the recording medium 13, and is an area that extends in the main scan direction to correspond to a scan range of the recording head cartridge 1.

Discharge of the ink toward the recording medium (recording operation) and conveying operation for a recording medium in the present recording apparatus constructed in the manner described above will be described.

Figure 3:
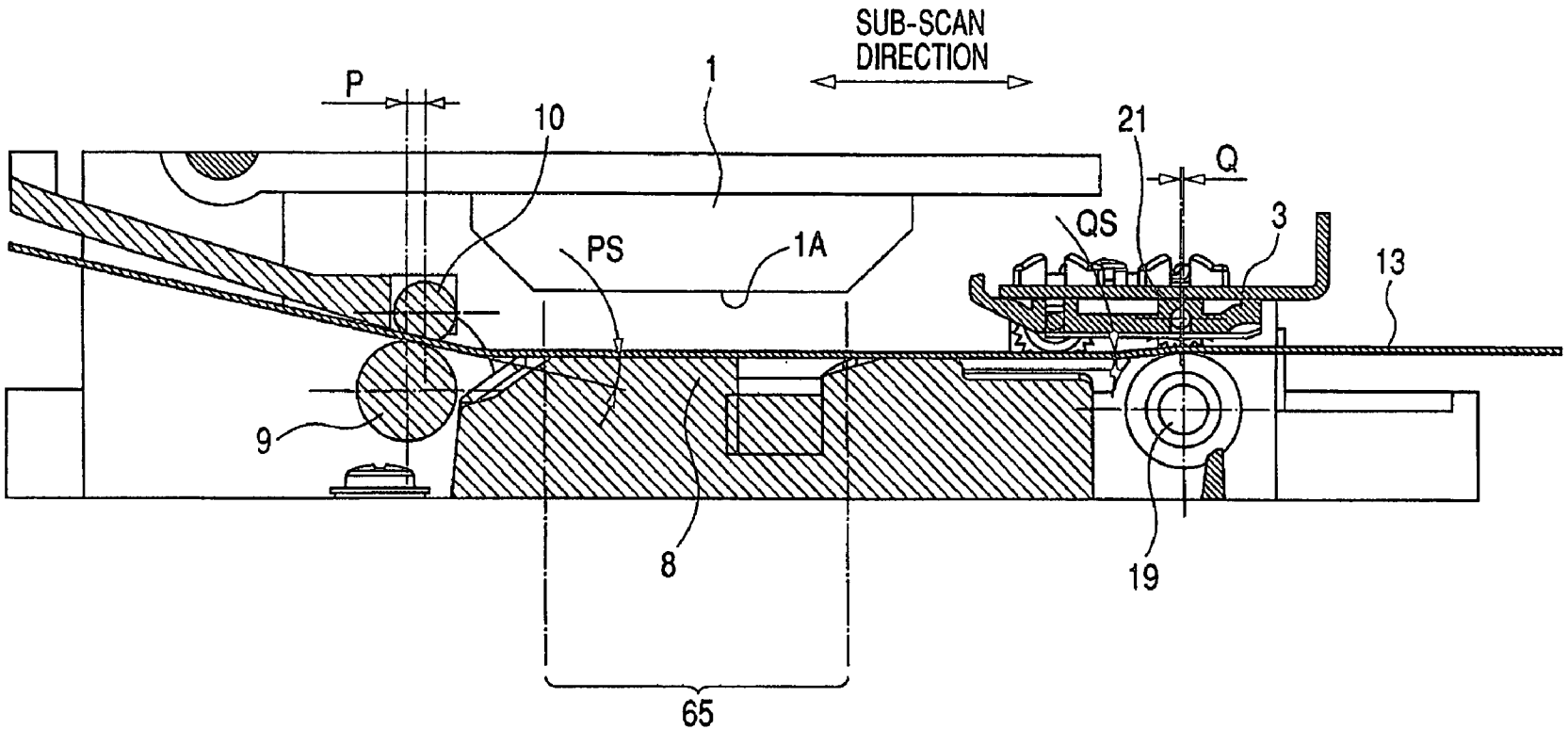
FIG. 3 is an enlarged view showing a part of FIG. 2A.

In a state in which the recording medium exists in the recording area 65 and the conveying is stopped as shown in FIG. 3, the ink is discharged from the recording head. The ink discharge is performed while moving the carriage 2 in the main scan direction, thereby forming one line of an image on the recording medium. Next, when one line of the image is formed, each roller is driven to convey the recording medium in the sub-scan direction by a predetermined distance. Then, the conveying is stopped again and recording of another line of the image is performed under this state in the same manner as above. By repeating the recording of one line and the intermittent conveying in the manner described above, sequential recording is performed onto the recording medium 13 and the recording medium having undergone the recording is sent out from the eject roller 19 side.

Incidentally, when performing such a recording operation, it is preferable that the recording medium 13 is held in a state in which it intimately contacts the upper surface of the platen 8 at the time of the ink discharge. This is because when the recording is performed in a state in which the recording medium floats from the upper surface of the platen, there occur variations in head gap and therefore the quality of an image to be formed is lowered. In addition, also from the viewpoint of favorably conveying the recording medium, it is preferable that the recording medium is pressed against the upper surface of the platen.

In order to press the recording medium against the upper surface of the platen, in the construction of this embodiment, arrangement of the rollers and the like are devised. That is, the pinch roller 10 and the conveying roller 9 are arranged so that centers thereof are displaced from each other in the sub-scan direction by a distance P. With this construction, the recording medium having passed through the nip between the rollers 9 and 10 is inclined downward by an angle PS with respect to the upper surface (plane) of the platen 8. By giving the angle in this manner, the the recording medium is pressed against the upper surface of the platen due to stiffness of the recording medium itself and therefore the floating of the recording medium becomes hard to occur.

In a like manner, the sheet eject roller 19 and the spur 21 are arranged so that centers thereof are displaced from each other by a distance Q. With this construction, the recording medium is inclined by an angle QS with respect to the upper surface of the platen and the same pressing effect is obtained also in an area in front of the sheet eject roller 19. In the manner described above, in the recording apparatus of this embodiment, between the conveying roller 9 and the sheet eject roller 19, the recording medium is brought into intimate contact with the upper surface of the platen.

It should be noted that as will be described later, the platen 8 is constructed so that an area on a movable side A8 (see FIG. 2B) is moved vertically with an axis of the sheet eject roller 19 as a rotation center. In such a construction in which the platen 8 is movable, when only the platen 8 is moved by setting the spur 21 and the like immovable, relative positional relations among the platen 8, the spur 21, and the like change. The changes of the positional relations among the platen 8, the spur 21, and the like result in a possibility that any inconvenience concerning the conveying or the recording may occur.

Therefore, in the construction of this embodiment, the spur 21 is supported by the spur stay 3 attached to the platen 8. With this construction, even when the platen 8 is moved, the spur 21 is also moved in accordance with the movement of the platen 8, so the relative positional relation between the platen and the spur does not change. As a result, for instance, an image distortion problem referred to as the "entry unevenness" also becomes hard to occur.

Next, a mechanism for moving the platen vertically will be described concretely with reference to FIG. 4 to FIG. 7B. This mechanism has a construction in which through movement of an approximately plate-shaped member (link 22) arranged below the platen 8 between two predetermined positions, the platen 8 contacting the link 22 is pushed up or down.

Figure 4:
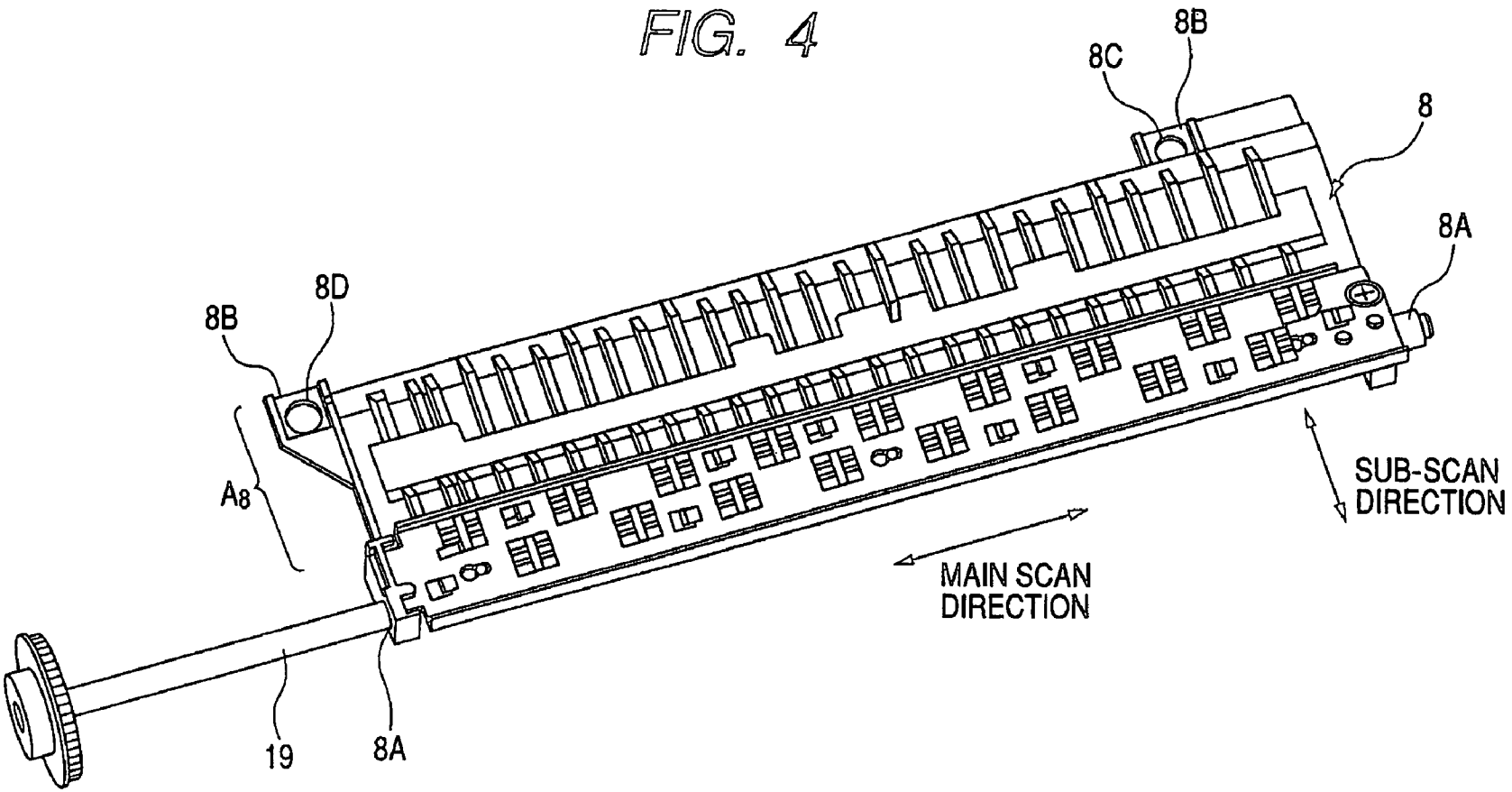
FIG. 4 is a perspective view showing an external appearance of a platen.

As shown in FIG. 4, one end side of the platen 8 is supported by an axis portion of the sheet eject roller 19 in a free-to-rotate manner and the area on the movable side A8 on a not-supported side rocks about the axis portion. The axis portion of the sheet eject roller 19 is passed through two bearing portions 8A respectively provided for both end portions in the main scan direction of the platen 8. Under an incorporated state into the recording apparatus, each bearing portion 8A is positioned on a downstream side in the sub-scan direction.

In the vicinity of each corner portion on the upstream side in the sub-scan direction of the area on the movable side A8, an arm portion 8B that protrudes from the other portion is formed. Also, one long hole 8C and one long hole 8D are formed in respective arm portions 8B. Note that each of the long holes 8C and 8D is illustrated as a circular hole in FIG. 4 but in an actual shape, it extends in the sub-scan direction. Bosses 20A of the main body base 20 to be described later are passed through the long holes 8C and 8D. By setting the holes 8C and 8D in not a circular shape but a long-hole shape, it is made possible to favorably move the platen 8 vertically while preventing interference between the bosses 20A and the holes (see FIGS. 2A and 2B). Also, as to the main scan direction, through sliding between outer peripheral surfaces of the bosses 20A and inner peripheral surfaces of the long holes or through reduction of gaps between the boss outer peripheral surfaces and the long hole inner peripheral surfaces to the minimum, a situation is obtained in which the bosses 20A function as guide members and regulate the position of the platen 8 in the main scan direction. This means that a wobble of the platen in the main scan direction is reduced.

Figure 5:
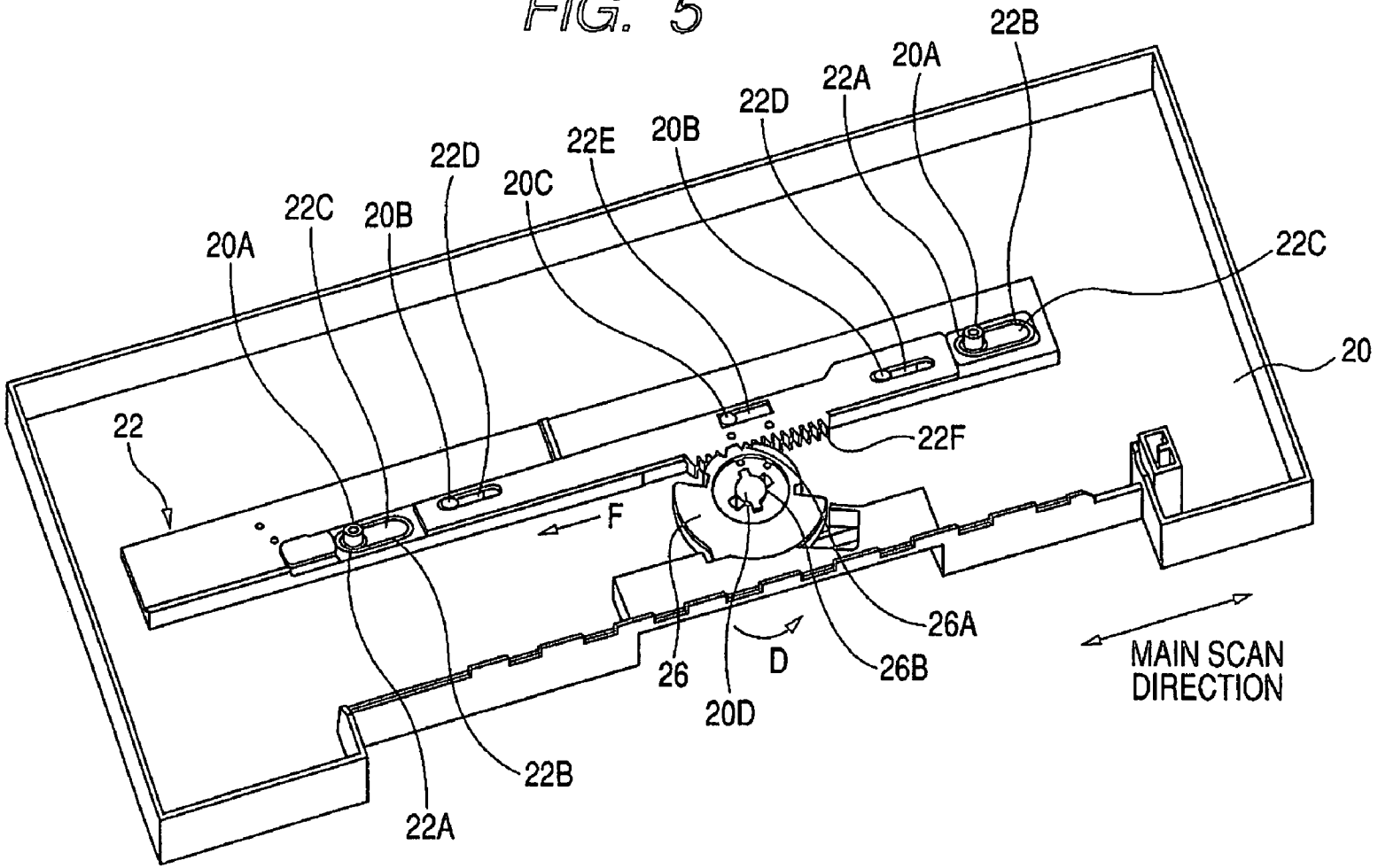
FIG. 5 is a perspective view showing a link and a lever member arranged on a main body base.
Figure 6:
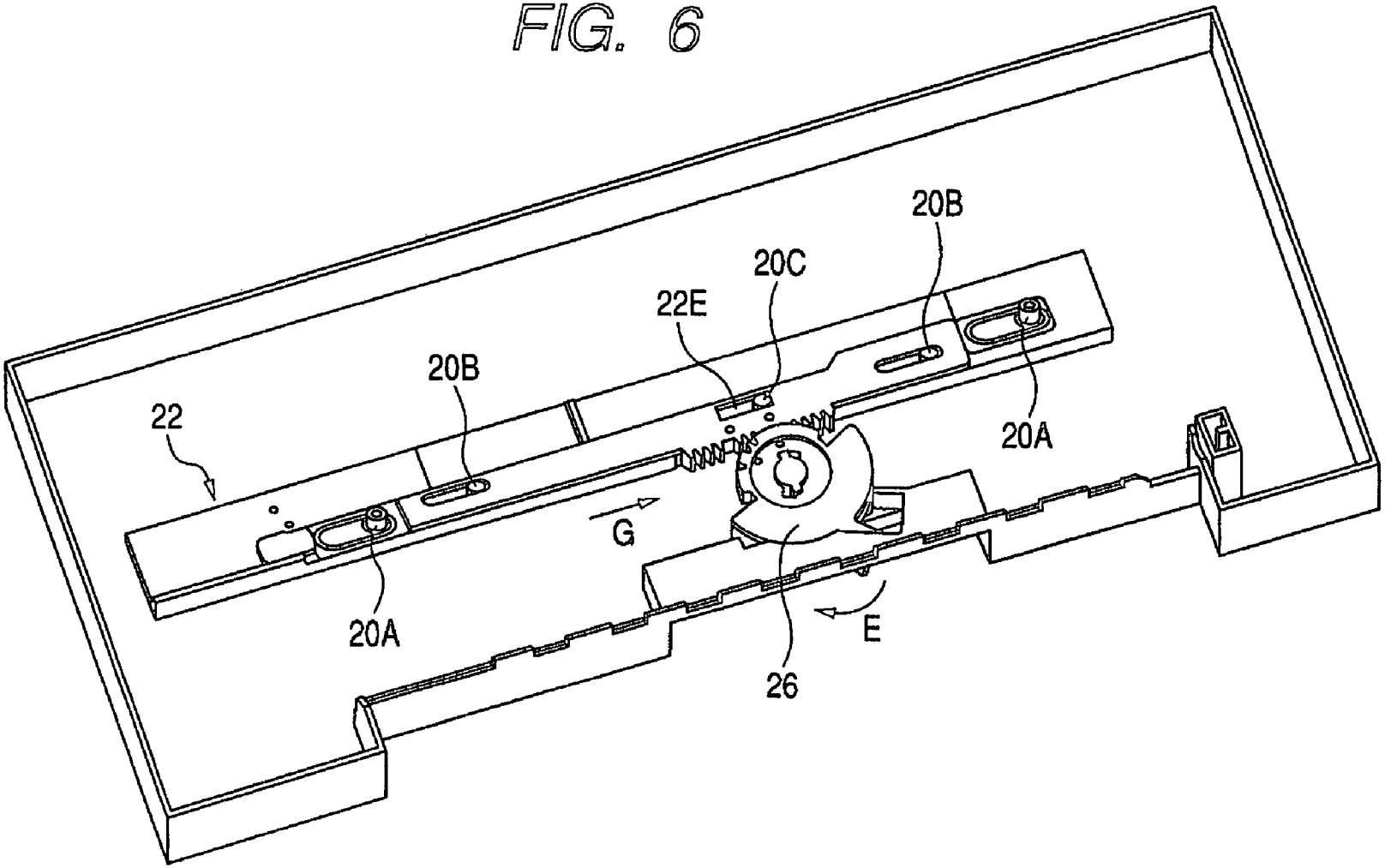
FIG. 6 is a perspective view showing the link and the lever member arranged on the main body base in a state in which the link exists at a position different from a position of FIG. 5.
Figure 7A:
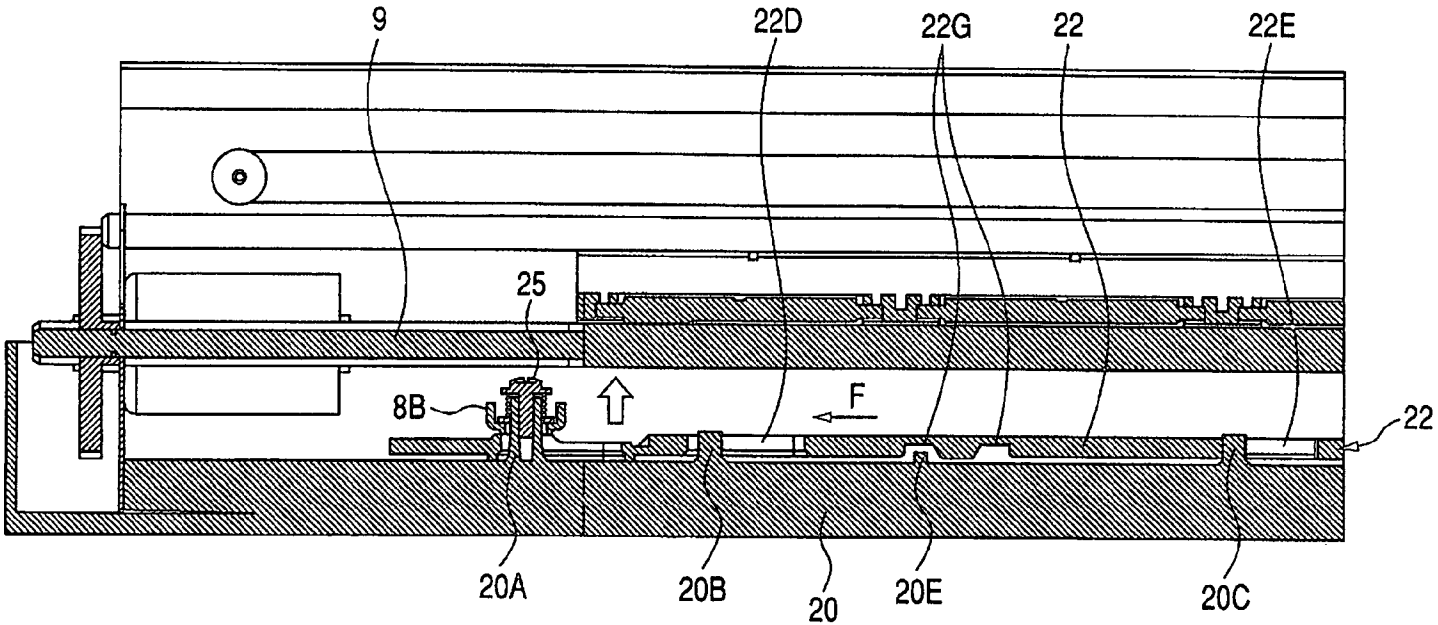
Figure 7B:
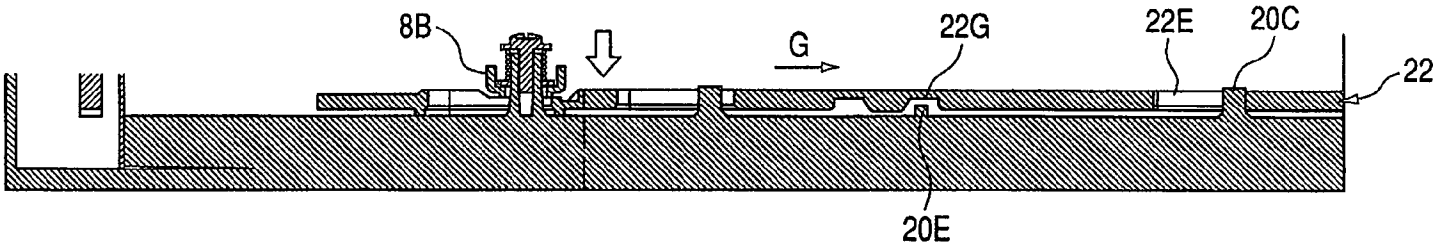

FIG. 5 shows a state in which the link 22 and a lever member 26 that moves the link 22 are arranged for the main body base 20, and FIG. 6 shows a state in which the link 22 is moved to another position. Also, FIGS. 7A and 7B are each a cross-sectional view showing positional relations among the main body base 20, the link 22, and the platen 8, with a position of the link 22 of FIG. 7A and that of FIG. 7B being different from each other.

As shown in FIG. 5 to FIG. 7B, the main body base 20 is a base member having a support surface formed in a planar manner and the link 22 and the lever member 26 are arranged on the support surface. For the support surface, several bosses (20A, 20B, and the like) for supporting the link 22 and the lever member 26 and for engaging with the members are provided.

The two bosses 20A are formed with a predetermined interval in-between in the main scan direction and two guide bosses 20B and one stopper boss 20C are formed between the two bosses 20A. The bosses 20A have threaded holes and are mainly used to attach the link 22 to the main body base. The bosses 20B and 20C regulate the moving direction of the link and the stopper boss 20C also has a function of defining a movable range of the link 22.

It should be noted that as is apparent from FIGS. 5 and 6, the link 22 is arranged at approximately the center of the support surface and the lever member 26 is arranged on a front side of the apparatus main body with respect to the link member 22. A lever portion 26C of the lever member 26 (see FIG. 1) protrudes from a front side of the main body base 20, thereby allowing a user to operate the lever portion 26C.

Next, the construction of the link 22 and the attachment of the link 22 to the main body base will be described.

The link 22 is a long member that extends in the main scan direction in a posture at the time of use and has several long holes corresponding to the bosses 20A to 20C of the main body base 20. That is, long holes 22C are formed at positions corresponding to the bosses 20A, guide long holes 22D are formed at positions corresponding to the guide bosses 20B, and a stopper long hole 22E is formed to correspond to the stopper boss 20C. With this construction, the link 22 is capable of reciprocatingly and linearly moving in its entirety along a long hole formation direction (main scan direction) by a predetermined distance.

As shown in FIGS. 7A and 7B, for the back surface of the link 22, two concave portions 22G are formed with a predetermined interval in the main scan direction. That is, a portion protruding downward is formed between the two concave portions 22G. Therefore, when the link 22 is moved from a state (state of FIG. 7A) in which a convex portion 20E provided on the main body base exists in one of the concave portions 22G, in a direction indicated by the arrow F, first, the protruding portion runs onto a convex portion 20E. When the link 22 is further moved in the direction indicated by the arrow F, the convex portion 20E goes in the other of the concave portions 22G (state of FIG. 7B).

The two concave portions 22G are formed to correspond to two positions that the link 22 can take in the manner described above. Also, with the construction in which the protruding portion runs onto the convex portion 20E in the manner described above, a feeling of click at the time of movement of the link 22 is obtained. Note that the feeling of click is obtained by the action of urging means for urging the link 22 against a base side. This will be described again later also with reference to other drawings.

Figure 8:
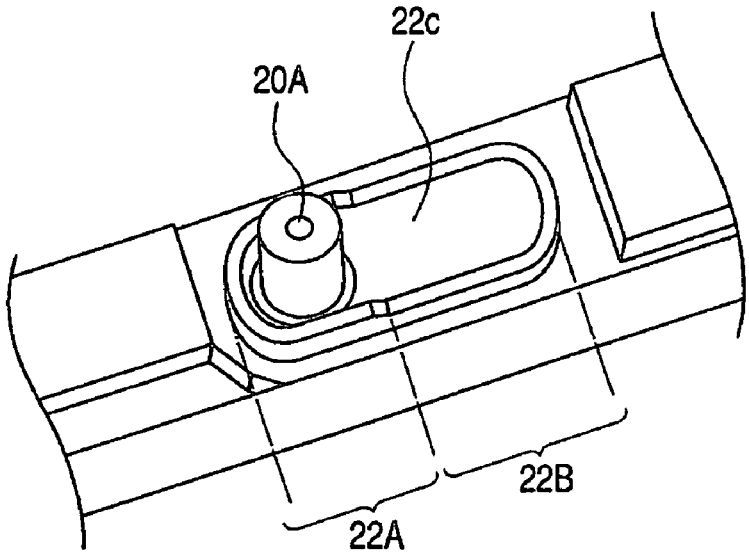
FIG. 8 is an enlarged perspective view showing a contact portion provided for a part of the link.

As shown in FIG. 8, for the outer peripheral edge of each long hole 22C through which one of the bosses 20A is inserted, a rib structural portion in a step shape is formed which contacts a part of the platen, and includes a first cam portion 22A and a second cam portion 22B whose rib heights are different from each other.

Figure 9:
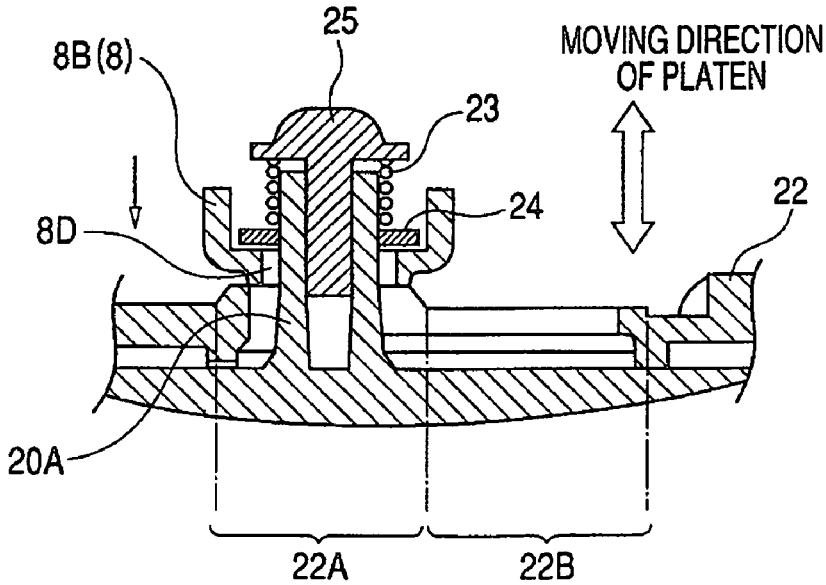
FIG. 9 is an enlarged view showing a part of FIGS. 7A and 7B.

As shown in FIGS. 7A, 7B, and 9, at each boss 20A, a part (arm portion 8B) of the platen is arranged on the link 22. At the boss 20A, a washer 24 and a platen spring 23 are further arranged on the arm portion 8B and the platen spring 23 is fixed under a compressed state through screwing of a screw 25 into the boss 20A. Under this state, an urging force by the platen spring 23 acts on the arm portion 8B of the platen 8 through the washer 24, and as a result of this, the arm portion 8B is pressed against the upper surface of the link 22, more specifically, the first cam portion 22A or the second cam portion 22B.

It should be noted that a construction in which the platen spring 23 is not provided is also possible. In this case, the arm portion 8B contacts the first cam portion 22A or the second cam portion 22B under its own weight. Even with such a construction, it is possible to move the platen 8 vertically in accordance with the position of the link 22. However, in order to keep the posture of the platen with stability by eliminating a wobble of the platen, the construction of this embodiment in which the platen is pressed down using the spring 23 is preferable.

Now referring again to FIGS. 5 and 6, a rack 22F that is a straight gear is formed in approximately the center portion in a lengthwise direction of the link 22 and meshes with a spur gear portion 26A formed for the lever member 26.

A lever axis 20D on a base side is inserted through a hole 26B formed at the center of the lever member 26, thereby making the lever member 26 rotatable about the axis 20D. Note that the operation portion (lever portion 26C, see FIG. 1) of the lever member 26 protrudes to the outside of the main body base 20 as described above and when the operation portion is operated, the lever member 26 rotates around the axis 20D.

An operation in which the platen 8 moves vertically in the recording apparatus of this embodiment constructed in the manner described above, will be described below. Note that in the following description, a position of the platen 8 at the time when the arm portion 8B of the platen exists on the first cam portion 22A will be referred to as the "first position" and a position of the platen at the time when the arm portion exists on the second cam portion 22B will be referred to as the "second position", and an operation in which the platen is moved from the first position to the second position will be described as an example.

In a state in which the platen 8 exists at the first position, each construction element is placed in a state shown in FIGS. 2A, 5, and 7A, for instance. That is, at the first position, the platen 8 takes a high position and therefore a distance between the discharge port surface and the platen upper surface is reduced. Such a state in which the head gap is small is a state that is assumed when recording is performed onto plain paper, for instance.

As shown in FIG. 7A, the arm portion 8B of the platen exists on the first cam portion of the link 22. The link 22 is placed in a state in which it will not move rightward in the drawing anymore, through contact between the outer peripheral surface of the stopper boss 20C and the inner peripheral wall of the long hole 22E. Also, the convex portion 20E of the main body base engages with the link concave portion 22G on the left side of the drawing.

When the lever member 26 is rotated from this state in a direction indicated by the arrow D (see FIG. 5), the link 22 moves in the direction indicated by the arrow F. The link 22 moves while being guided by the guide bosses 20B and the like until the outer peripheral surface of the stopper boss 20C is bumped against the inner peripheral wall on an opposite side of the long hole 22E.

As the link 22 moves, at each boss 20A (see FIG. 9), the arm portion 8B moves from the first cam portion 22A to the second cam portion 22B under its own weight and due to the urging force by the spring. Thus, the platen 8 rotates around the axis of the roller 19 and is switched to the second position. As a result of the switching to the second position, the head gap is increased by a difference in height between the first cam portion 22A and the second cam portion 22B, and it becomes possible to perform recording onto thick paper such as a postal card. Note that even in the state in which the arm portion 8B contacts the second cam portion 22B, the urging force by the spring 23 acts on the arm portion 8B.

Here, as described above, when the link 22 is moved, at one of the concave portions 22G of the link back surface (see FIGS. 7A and 7B), the protruding portion between the concave portions 22G first runs onto the convex portion 20E, and then the convex portion 20E goes in the other of the concave portions 22G. The link 22 receives the urging force from the spring 23, so when the protruding portion runs onto the convex portion 20E, sliding between the lower surface of the protruding portion and the upper surface of the convex portion occurs and a feeling of operation of the lever member 26 is heavy. When the convex portion 20E gets over the protruding portion and goes in the other concave portion 22G, it does not contact the link member anymore, so the feeling of operation of the lever member 26 is light. In this embodiment, such a difference in feeding of operation is obtained as a feeling of click.

In the recording apparatus 50 of this embodiment, through the operation described above, the posture of the platen 8 can be switched from the first position to the second position. Also, through an operation reverse to the operation described above, the platen is switched from the second position to the first position.

In the conventional recording apparatus, the head gap is adjusted by moving the carriage side while fixing the platen side. In the recording apparatus of this embodiment, however, the head gap is adjusted by moving the platen side while fixing the carriage side. With the conventional construction in which the carriage side is moved, there is a necessity to secure a space for moving the carriage in a casing, which is disadvantageous in miniaturization of the recording apparatus. With the construction in this embodiment, however, it is unnecessary to secure such a space, which is advantageous in miniaturization of the recording apparatus.

Also, with the conventional construction in which the carriage side is moved, it is required to provide a predetermined mechanism for the carriage or the like. In this, embodiment, however, it is not required to provide such a mechanism for the carriage side and therefore it is expected that reduction in weight of the carriage will be achieved. As a result, various effects, such as an effect that miniaturization of the drive motor 6 is possible, are provided.

Further, in this embodiment, as shown in FIG. 4, one end side of the platen 8 is supported by the axis portion of the eject roller 19. The eject roller 19 is a member that is provided in every conventional and general recording apparatus of this type. Therefore, the construction of this embodiment in which the platen is supported by the axis portion of the roller 19 is preferable because it is unnecessary to add a special member for supporting the platen with this construction.

Still further, the long holes 8C and 8D are respectively formed in the two arm portions 8B integrally provided for the platen 8 and the bosses 20A are passed through the respective long holes. Therefore, the bosses 20A function as guide members and a wobble in the main scan direction of the platen 8 is suppressed to the minimum.

Also, the two concave portions 22G are formed for the back surface of the link 22 for vertically moving the platen and a feeling of click at the time of operation of the lever member is obtained with this construction. A construction in which such a structural portion for obtaining the feeling of click is provided for the lever member 26 is also possible, for instance. However, the construction of this embodiment in which such a mechanism is directly provided for the link 22 is more preferable because it is possible to obtain a more favorable feeling of click and better responsiveness with this construction.

It should be noted that the case of this specification in which the concave portions 22G and the convex portion 20E engage with each other is not limited to a case in which the structural portions contact each other, and includes a case in which the convex portion 20E exists inside the concave portions 22G under a non-contact state as shown in FIGS. 7A and 7B.

The first embodiment is described above. However, the recording apparatus according to the present invention may include a sensor 27 in addition to the construction elements described above, for instance, as shown in FIG. 10.

Figure 10:
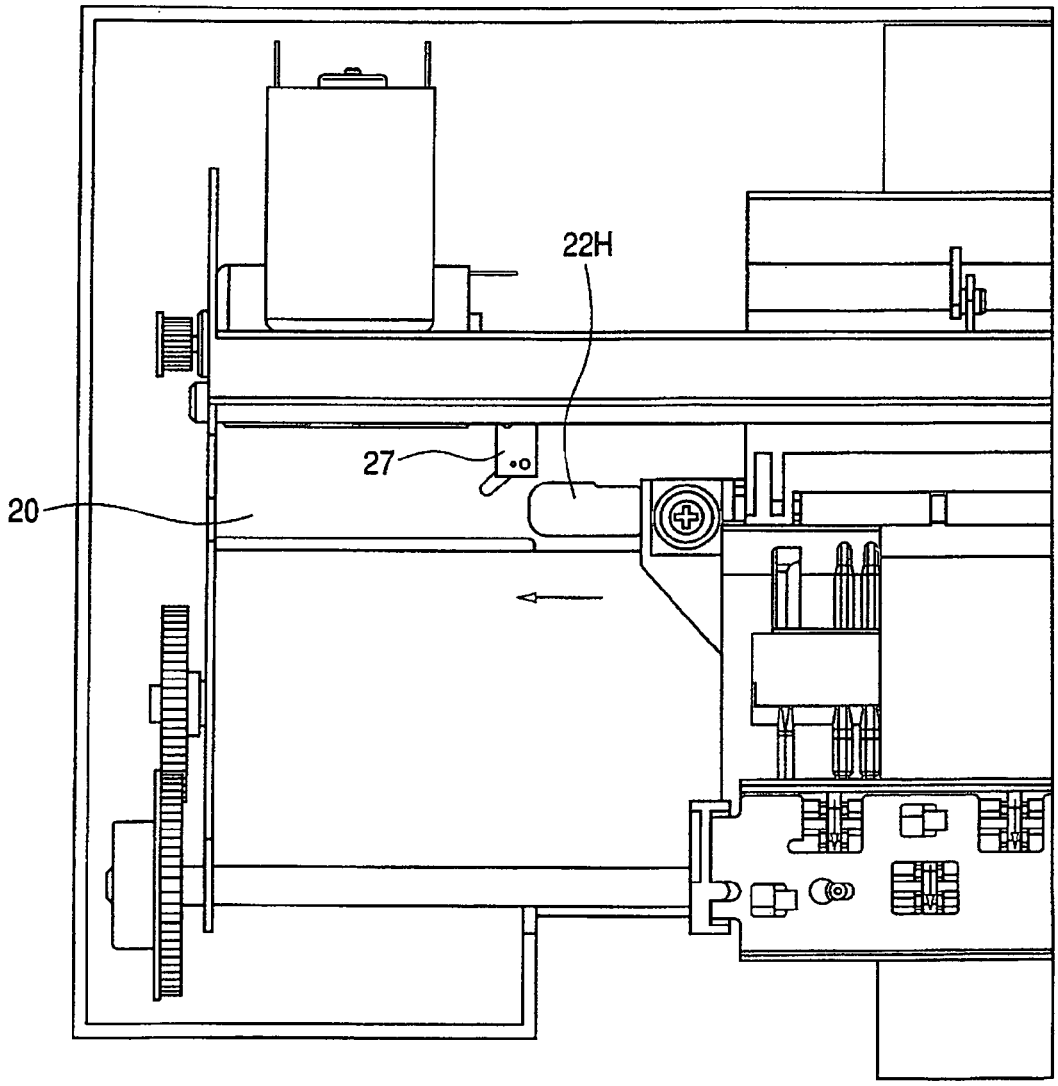
FIG. 10 is a top view showing a construction provided with a sensor that detects a position of the link.

The sensor 27 transmits a predetermined electric signal when an arm portion thereof is displaced due to contact between the arm portion and an object, and is constructible as a switch of contact type, for instance. The arrangement position of the sensor 27 is not specifically limited and the sensor 27 is attached to the main body base 20, for instance. Reference symbol 22H of FIG. 10 denotes a switch pressing portion formed to protrude from an end portion in the main scan direction of the link 22. Note that the position of the switch pressing portion 22H shown in FIG. 10 is a position at the time when the platen exists at the first position, that is, the arm portion 8B exists on the first cam portion 22A.

Figure 11:
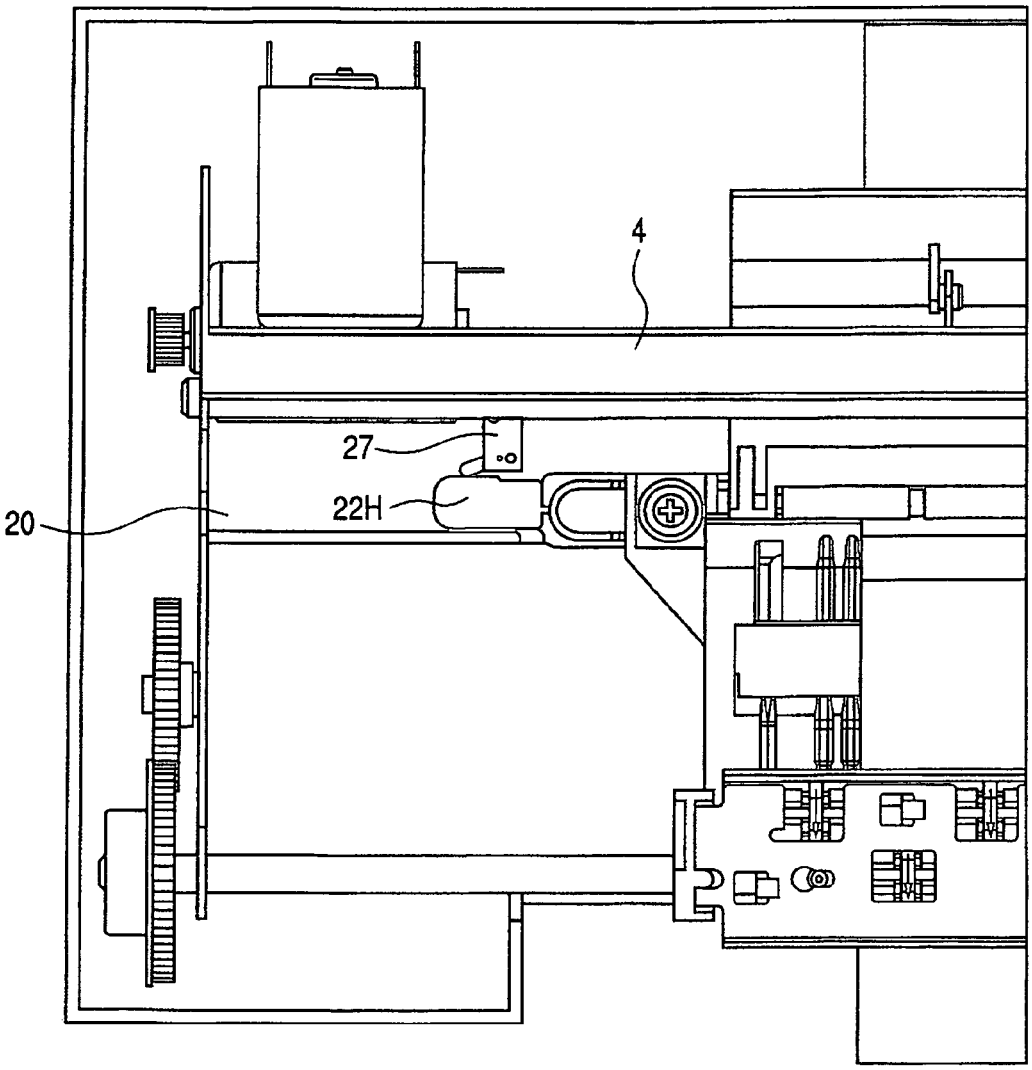
FIG. 11 is a top view showing a state in which the link has been moved from a state of FIG. 10 and the sensor has been activated.

When the link 22 is moved from this state in a direction indicated by an arrow of the drawing, as shown in FIG. 11, the switch pressing portion 22H contacts the arm portion of the sensor 27. As a result, the sensor 27 transmits the predetermined signal to a control substrate of the recording apparatus. When such a sensor 27 is used, it becomes possible to confirm the position of the link 22, so it is possible for the recording apparatus main body to recognize the posture of the platen corresponding to the position of the link. Therefore, for instance, when a user feeds paper using a driver of a personal computer, it is possible to judge whether the thickness of the paper selected using the driver and the head gap agree with each other and, when a result of this judgment is negative, issue a warning or the like to inform the user of this situation.

It should be noted that the sensor 27 is not limited to the sensor described above that detects the position of the link 22 and any sensor that directly detects the position of the platen 8 may be used instead.

Second Embodiment

In the first embodiment, the construction in which the platen takes two postures that are the first position and the second position is described as an example, but a construction in which the platen takes three or more postures may be used instead. Also, the postures of the platen are not limited to postures corresponding to a time of recording and may include a posture described below, for instance. The posture will be described below with reference to FIGS. 12 and 13.

Conventionally, there is a case where in a recording apparatus of this type, under a packed state of the recording apparatus for conveyance to the user, a carriage 2 moves in a main scan direction due to a shock at the time of the conveyance or the like and the recording apparatus gets out of order. In view of this problem, in a recording apparatus shown in FIGS. 12 and 13, a carriage engagement portion 8E is provided for a platen 8 and two engagement portions 2A are provided for the carriage 2. The carriage engagement portion 8E is a structural portion that extends from the platen 8 toward the carriage 2 side, and the engagement portions 2A have constructions in which the carriage engagement portion 8E is sandwiched between the engagement portions 2A.

Figure 12:
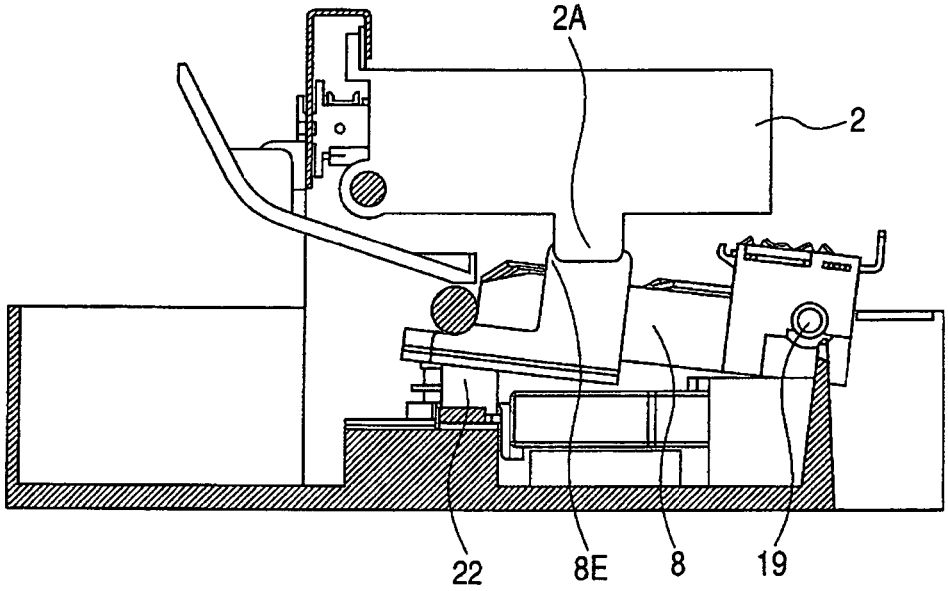
FIG. 12 is a cross-sectional view showing a construction of a recording apparatus according to a second embodiment.
Figure 13:
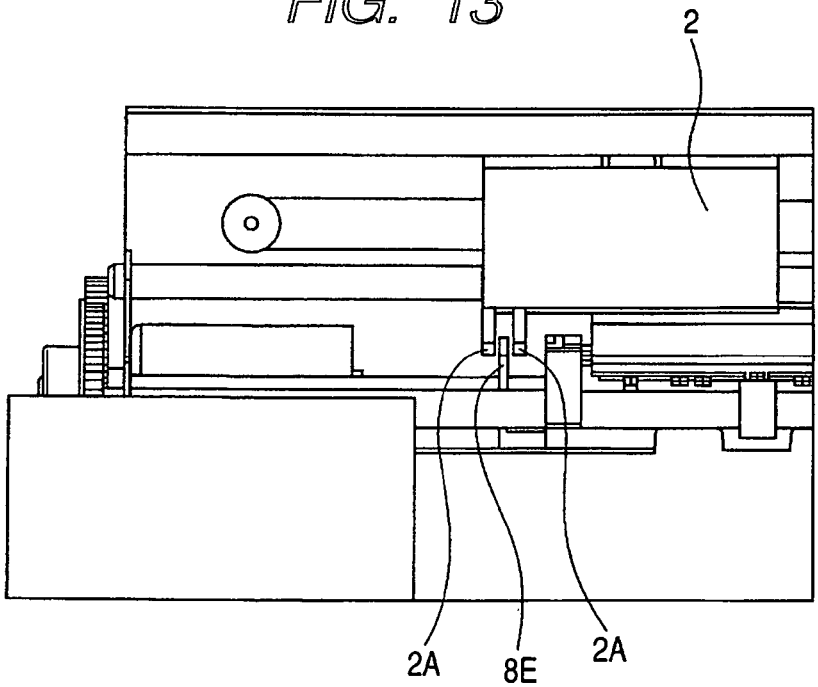
FIG. 13 is a front view showing the construction of the recording apparatus according to the second embodiment.

Also, for a link 22, a higher portion (contact portion) (not shown) is formed in addition to a first cam portion 22A and a second cam portion 22B. Further, a movable range in a main scan direction of the link 22 is increased in accordance with the formation of the higher portion. With this construction, when an arm portion 8B of the platen is positioned at the highest contact portion of the link through an operation of a lever member, as shown in FIG. 12, the platen 8 takes a higher third position. At this position, the carriage fixation portion 8E and the fixation portions 2A engage with each other and therefore a movement in the main scan direction of the carriage 2 is regulated.

With the construction of the second embodiment described above, at the time of conveyance or the like, the platen 8 is positioned at the third position, thereby regulating the movement in the main scan direction of the carriage 2. As a result, even when a shock is given during the conveyance or the like, the movement of the carriage is prevented and therefore a failure of the carriage becomes hard to occur.

It should be noted that the present invention is not limited to the application to the recording apparatus based on the ink jet system and is applicable also to recording apparatuses of other types so long as conveying rollers, eject rollers, platens, and the like are included. Also, the present invention is not limited to the construction in which the platen 8 is pivotally supported by the axis portion of a sheet eject roller 19, and a construction in which the platen 8 is supported by an axis portion of the conveying roller 9 is also possible, for instance.

According to the embodiments of the present invention, a construction is realized in which the head gap is adjusted through movement of the platen side, and therefore is advantageous in miniaturization of the recording apparatus.

This application claims priority from Japanese Patent Application No. 2005-139560 filed on May 12, 2005, which is hereby incorporated by reference herein.

What is claimed is:

1. A recording apparatus, comprising:

a carriage mounted with recording means for forming an image on a recording medium and which serves to move the recording means in a main scan direction;

a roller for conveying the recording medium in a direction intersecting the main scan direction;

a platen for supporting the recording medium in an area in which the image is formed, the platen being rockable about an axis of the roller and switchable between at least two positions;

a link member movably disposed below the platen; and urging means for urging the platen against a link member side thereof, wherein a cam portion having different heights corresponding to the positions of the platen is provided at a portion of the link member against which a part of the platen is pressed, and when the link member is moved, a contact state between the cam portion and the part of the platen is switched to change the position of the platen, wherein the platen is formed with an arm portion that is pressed against the cam portion of the link member, and wherein a long hole, which extends in a sub-scan direction and through which a boss is inserted, is formed in the arm portion and a position in the main scan direction of the platen is regulated by the long hole and the boss.

2. A recording apparatus according to claim 1, further comprising a lever member supported by a main body base of the recording apparatus, for moving the link member through rotation, wherein the lever member comprises an operation portion operated by a user.

3. A recording apparatus according to claim 2, wherein the link member is provided with a rack, the lever member is provided with a gear that engages with the rack, and the rotation of the lever member is converted into rectilinear motion of the link member.

4. A recording apparatus, comprising:

a carriage mounted with recording means for forming an image on a recording medium and which serves to move the recording means in a main scan direction;

a roller for conveying the recording medium in a direction intersecting the main scan direction;

a platen for supporting the recording medium in an area in which the image is formed, the platen being rockable about an axis of the roller and switchable between at least two positions;

a link member movably disposed below the platen;

urging means for urging the platen against a link member side thereof, wherein a cam portion having different heights corresponding to the positions of the platen is provided at a portion of the link member against which a part of the platen is pressed, and when the link member is moved, a contact state between the cam portion and the part of the platen is switched to change the position of the platen; and a lever member supported by a main body base of the recording apparatus, for moving the link member through rotation, wherein the lever member comprises an operation portion operated by a user, wherein at least two concave portions are formed on a back surface of the link member with a distance therebetween, a convex portion that engages with the at least two concave portions is formed for the main body base, and a feeling of click at a time of movement of the link member is obtained through running of a protruding portion provided between the at least two concave portions onto the convex portion.

5. A recording apparatus according to claim 4, further comprising a sensor for detecting a position of the link member or a position of the platen.

6. A recording apparatus according to claim 1, wherein the platen is switchable to a position in which the platen and the carriage engage with each other and movement in the main scan direction of the carriage is regulated.

* * * * *